US008968478B2

(12) United States Patent
Takeshima et al.

(10) Patent No.: US 8,968,478 B2
(45) Date of Patent: Mar. 3, 2015

(54) PRETREATMENT METHOD FOR SACCHARIFICATION OF PLANT FIBER MATERIAL AND SACCHARIFICATION METHOD

(75) Inventors: Shinichi Takeshima, Numazu (JP); Takeshi Kikuchi, Numazu (JP)

(73) Assignee: Toyota Jidosha Kabushiki Kaisha, Toyota-shi, Aichi-ken (JP)

( * ) Notice: Subject to any disclaimer, the term of this patent is extended or adjusted under 35 U.S.C. 154(b) by 848 days.

(21) Appl. No.: 13/254,252

(22) PCT Filed: Mar. 8, 2010

(86) PCT No.: PCT/IB2010/000676

§ 371 (c)(1), (2), (4) Date: Sep. 1, 2011

(87) PCT Pub. No.: WO2010/100563

PCT Pub. Date: Sep. 10, 2010

(65) Prior Publication Data

US 2011/0315138 A1 Dec. 29, 2011

(30) Foreign Application Priority Data

Mar. 6, 2009 (JP) ..... 2009-053796

(51) Int. Cl.
*C13K 1/02* (2006.01)
*C13K 1/04* (2006.01)

(52) U.S. Cl.
CPC .... *C13K 1/02* (2013.01); *C13K 1/04* (2013.01)
USPC ..... 127/37

(58) Field of Classification Search
None
See application file for complete search history.

(56) References Cited

U.S. PATENT DOCUMENTS

2010/0126501 A1* 5/2010 Takeshima et al. ..... 127/37

FOREIGN PATENT DOCUMENTS

| | | |
|---|---|---|
| EP | 1 860 201 A1 | 11/2007 |
| JP | 2001-95594 | 4/2001 |
| JP | 2007-151433 | 6/2007 |
| JP | 2008-271787 | 11/2008 |
| JP | 2009-291085 | 12/2009 |
| WO | WO 2008/132605 A1 | 11/2008 |

OTHER PUBLICATIONS

R. Swatloski et al., "Dissolution of Cellose with Ionic Liquids," J. Am. Chem. Soc., vol. 124, pp. 4974-4975 (2002).
International Search Report in International Application No. PCT/IB2010/000676; Mailing Date: Jun. 30, 2010.
Written Opinion of the International Searching Authority in International Application No. PCT/IB2010/000676; Mailing Date: Jun. 30, 2010.

(Continued)

*Primary Examiner* — Melvin C Mayes
*Assistant Examiner* — Stefanie Cohen
(74) *Attorney, Agent, or Firm* — Finnegan, Henderson, Farabow, Garrett & Dunner, LLP

(57) ABSTRACT

A pretreatment method for saccharification of plant fiber materials includes: immersing the plant fiber material in a solution that contains an organic solvent, in which a cluster acid is dissolved, prior to saccharifying cellulose contained in the plant fiber material; and distilling off the organic solvent from the immersed plant fiber material to obtain a pretreated mixture that contains the cluster acid and the pretreated plant fiber material.

10 Claims, 6 Drawing Sheets

(56) References Cited

OTHER PUBLICATIONS

Notification of Reason(s) for Refusal in Japanese Patent Application No. 2009-053796; Drafting Date: Feb. 1, 2011.
Bhilare, S. et al., "An efficient and direct route to the synthesis of diaryl sulfoxides catalyzed by heterpoly acid," Journal of Molecular Catalysis A:Chemical 270, (2007), pp. 123-126.
Arai, K., "Hydrolysis of Cellulose Fiber in the Presence of 12-Tungstosilicic Acid," Journal of Applied Polymer Science, vol. 30, (1985), pp. 3051-3057.
Fine Chemicals, vol. 38, Jun. 10, 2009, pp. 61-65.
Proceedings of the 102$^{nd}$ Catalyst Symposium A, Sep. 23, 2008, p. 55.

* cited by examiner

PRETREATMENT METHOD FOR SACCHARIFICATION OF PLANT FIBER MATERIAL AND SACCHARIFICATION METHOD

CROSS-REFERENCE TO RELATED APPLICATIONS

This application is a national phase application of International Application No. PCT/IB2010/000676, filed Mar. 8, 2010, and claims the priority of Japanese Application No. 2009-053796, filed Mar. 6, 2009, the contents of both of which are incorporated herein by reference.

BACKGROUND OF THE INVENTION

1. Field of the Invention

The invention relates to a pretreatment method for saccharification of a plant fiber material during saccharification of a plant fiber material that forms a monosaccharide by hydrolyzing the plant fiber material, and to a saccharification method.

2. Description of the Related Art

Biomass in the form of plant fiber has been proposed for effective use as food or fuel by decomposing, for example, sugar cane bagasse or wood chips to form sugars consisting mainly of glucose and xylose from cellulose and hemicellulose and using the resulting sugars, and this plant fiber is currently being used practically. Attention is being focused particularly on a technology for producing alcohols such as ethanol for fuel by fermenting monosaccharides obtained by decomposition of plant fiber. Various methods have been previously proposed involving the production of sugars such as glucose by decomposing cellulose and hemicellulose, an example of a typical method thereof consists of hydrolysis of cellulose using sulfuric acid, such as dilute sulfuric acid or concentrated sulfuric acid, or hydrochloric acid. In addition, other methods use cellulase enzyme, a solid catalyst such as activated charcoal or zeolite, or pressurized hot water.

However, methods that hydrolyze cellulose using an acid such as sulfuric acid present difficulty in separating the catalyst in the form of the acid and the sugar produced from the saccharification reaction mixture obtained as a result of hydrolysis. This is because glucose, which is the main component of hydrolysis products of cellulose, and acid, which serves as the catalyst of hydrolysis, are both soluble in water. Removal of acid from a saccharification reaction mixture by neutralization or ion exchange and the like not only results in increased complexity and costs, but also has difficulty in completely removing the acid, thereby frequently causing acid to remain in the ethanol fermentation process. As a result, even if the ethanol fermentation process is adjusted to the optimum pH for yeast activity, the activity of the yeast decreases due to the increased concentration of acid, thereby leading to a decrease in fermentation efficiency.

In the case of using concentrated sulfuric acid in particular, a large amount of energy is required to remove the sulfuric acid since it is extremely difficult to remove the acid to a degree that does not deactivate the yeast in the ethanol fermentation process. In contrast, in the case of using dilute sulfuric acid, although the sulfuric acid can be removed comparatively easily, energy is again required since the cellulose must be decomposed under high temperature conditions. Moreover, it is extremely difficult to separate, recover and reuse acids such as sulfuric acid or hydrochloric acid. Consequently, the use of these acids as catalysts for glucose formation is one of the causes that drives up the cost of purifying bioethanol.

In addition, in methods that use pressurized hot water, it is difficult to adjust conditions and form glucose at a stable yield. Not only is there the risk of the glucose also decomposing resulting in a decrease in glucose yield, but there is also the risk of the function of the yeast being decreased by decomposition components, thereby inhibiting fermentation. Moreover, the reaction apparatus (supercritical apparatus) is expensive while low durability also causes problems in terms of cost.

Japanese Patent Application Publication No. 2008-271787 (JP-A-2008-271787) and Japanese Patent Application No. 2008-145741 disclose that a cluster acid in a pseudo-molten state or dissolved state has superior catalytic activity with respect to decomposition of cellulose and is easily separated from sugars produced. According to this disclosed technology, differing from the concentrated sulfuric acid method and dilute sulfuric acid method described above, together with enabling recovery and reuse of the hydrolysis catalyst, energy efficiency of the process from hydrolysis of cellulose to recovery of an aqueous sugar solution and recovery of the hydrolysis catalyst can be improved.

However, naturally-occurring plant fiber materials such as wood chips or bagasse contain lignin in addition to cellulose and hemicellulose, and these components are present in the form of complex mixtures. Lignin lowers the ease of contact of cellulose and hemicellulose with catalyst; thereby impairing the saccharification reaction thereof. In addition, since wood-based plant fibers have water-repellent pectin on the surface thereof, these fibers mix poorly with the catalyst and water. Consequently, it is difficult for cluster acid or water to penetrate into wood-based plant fibers, thereby lowering the saccharification reactivity of the cellulose and hemicellulose. As has been previously described, naturally-occurring plant fiber materials, and particularly wood-based plant fiber materials, are susceptible to decreases in saccharification rate due to decreases in reactivity of the cellulose and hemicellulose attributable to lignin and pectin. Thus, in order to increase the saccharification reactivity of plant fiber materials according to the above-mentioned disclosed technology, it is necessary to carry out pretreatment in advance so as to facilitate reaction of cellulose in the presence of lignin, for example.

SUMMARY OF THE INVENTION

The invention provides a pretreatment method for saccharification of plant fiber materials that enables naturally-occurring plant fiber materials such as wood chips to be saccharified in a short period of time while also allowing an increase in saccharification rate, and a saccharification method.

A first aspect of the invention relates to a pretreatment method for saccharification of plant fiber materials, including: immersing the plant fiber material in a solution that contains an organic solvent in which a cluster acid is dissolved prior to saccharifying cellulose contained in the plant fiber material, and distilling off the organic solvent from the immersed plant fiber material to obtain a pretreated mixture that contains the cluster acid and pretreated plant fiber material.

With this constitution, by preliminarily immersing a plant fiber material in an organic solvent solution in which a cluster acid has been dissolved (immersion step) prior to a saccharification step, pectin contained in the plant fiber material is decomposed by the action of the dissolved cluster acid. Pectin impairs contact between cellulose and hemicellulose present within plant fiber materials and a saccharification catalyst such as cluster acid. Consequently, decomposition and removal of pectin promotes penetration of saccharification catalyst into the plant fiber material in the saccharification step, thereby improving contact between the saccharification catalyst and cellulose and the like. Namely, the saccharification reaction of the cellulose and hemicellulose in the saccharification step is promoted. In addition, crystallinity of cellulose in the plant fiber material decreases due to the action of the cluster acid in the saccharification step. This decrease in cellulose crystallinity enhances the saccharification reactivity of cellulose, thereby improving the saccharification rate of the plant fiber material. Moreover, a portion of amorphous cellulose of the plant fiber material is hydrolyzed and saccharified in the immersion step by the dissolved cluster acid. As has been previously described, the saccharification reaction of a plant fiber material in a subsequent saccharification step can be promoted by an immersion step in a pretreatment method. For this reason, the saccharification step of the plant fiber material can be shortened and the saccharification rate can be improved, while further making it possible to anticipate the use of lower temperatures in the saccharification step.

Moreover, a pretreated mixture obtained by distilling off an organic solvent used to dissolve the cluster acid (distillation step) following the immersion step can be introduced into the saccharification step either directly or by adding components required for the saccharification step or removing the cluster acid as necessary.

In the pretreatment method according to this aspect, immersion of the plant fiber material may be carried out at a temperature of 15 to 40° C., and the temperature may be the temperature of the organic solvent in which the cluster acid is dissolved.

In the pretreatment method according to this aspect, the solubility of the cluster acid with respect to the organic solvent may be 100 g/100 ml or more, the boiling point of the organic solvent may be 50 to 100° C., and the organic solvent may be ethanol.

In the pretreatment method according to this aspect, the cluster acid may be a heteropoly acid represented by the following chemical formula HwAxByOz, A may represent one element selected from the group consisting of phosphorous, silicon, germanium, arsenic and boron, and B may represent at least one type of element selected from the group consisting of tungsten, molybdenum, vanadium and niobium.

In the pretreatment method according to this aspect, the weight ratio of the cluster acid to the plant fiber material may be from 0.5 to 3. In the pretreatment method according to this aspect, the plant fiber material may contain pectin and lignin.

In the pretreatment method according to this aspect, the plant fiber may be saccharified by hydrolyzing the cellulose to produce a monosaccharide.

A second aspect of the invention relates to a saccharification method of a plant fiber material, including: hydrolyzing cellulose contained in the plant fiber material in a pretreated mixture with a cluster acid present in the pretreated mixture produce a monosaccharide, the pretreated mixture being obtained by a pretreatment method for saccharification of the plant fiber material that includes immersing the plant fiber material in a solution that contains an organic solvent in which a cluster acid is dissolved prior to saccharifying cellulose contained in the plant fiber material, and distilling off the organic solvent from the immersed plant fiber material to obtain the pretreated mixture that contains the cluster acid and a pretreated plant fiber material.

With this constitution, saccharification of a plant fiber material can be carried out after loading the pretreated mixture obtained according to the pretreatment method into a saccharification step and using the cluster acid contained in the pretreated mixture as a saccharification catalyst.

According to the invention, saccharification can be carried out in a short period of time and saccharification rate can be improved even in the case of naturally-occurring plant fiber materials such as wood chips. Moreover, the saccharification reaction temperature can be expected to be lowered.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF EMBODIMENTS

Figure 1A:
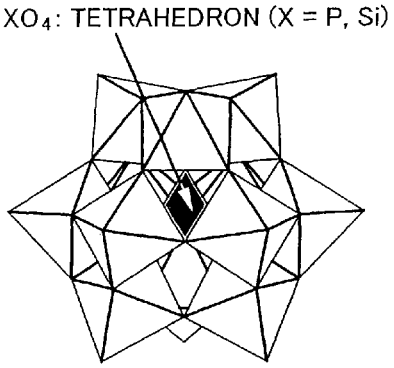
FIGS. 1A and 1B are a drawing showing the keggin structure of heteropoly acid.

The pretreatment method for saccharification of a plant fiber material according to embodiments of the invention includes: (1) an immersion step, in which the plant fiber material is immersed in an organic solvent solution of a cluster acid that at least contains a cluster acid and an organic solvent in which the cluster acid is soluble, and (2) a distillation step, in which a pretreated mixture that at least contains the cluster acid and pretreated plant fiber material is obtained after the immersion step by distilling off the organic solvent, which are carried out prior to a saccharification step, in which cellulose contained in the plant fiber material is saccharified, during saccharification of a plant fiber material that forms a monosaccharide by hydrolyzing the plant fiber material.

Although typical cluster acids such as a heteropoly acid have a diameter of about 1 to 2 nm, and typically greater than 1 nm, and have a molecular size that enables them to diffuse in a plant fiber material, complex mixtures of cellulose, hemicellulose and lignin are present in naturally-occurring plant fiber materials, and these substances inhibit diffusion of the cluster acid. In addition, penetration of the cluster acid and water into the plant fiber material is inhibited by water-repellent pectin that is contained in plant fiber materials.

The inventors found that by carrying out the immersion step (1) described above using a cluster acid that demonstrates superior catalytic action on hydrolysis (saccharification) of cellulose and hemicellulose, saccharification rate of the plant fiber material can be improved and saccharification reaction time can be shortened in the manner described below. In the pretreatment method according to the embodiments, in addition to cluster acid demonstrating actions that promote saccharification of cellulose and hemicellulose, lower crystallinity of crystalline cellulose and promote decomposition of pectin, the penetrability of the cluster acid into the plant fiber material increases as a result of being dissolved in an organic solvent. As a result of immersing the plant fiber material in an organic solvent solution of cluster acid that contains dissolved cluster acid in this manner, water-repellent components such as pectin on the surface of the plant fiber material are decomposed by the dissolved cluster acid, thereby lowering the water repellency of the plant fiber material. In addition, the dissolved cluster acid penetrates between lignin present in the plant fiber material. As a result, the plant fiber material mixes easily with water and the saccharification catalyst such as a dissolved or pseudo-melted cluster acid.

As a result, penetrability of the dissolved cluster acid into the plant fiber material improves, thereby resulting in improved contact with cellulose and hemicellulose contained in the plant fiber material. In addition, decomposition of pectin not only improves mixing of the plant fiber material with water and saccharification catalyst, but also increases the opportunities for cellulose and hemicellulose to contact water and saccharification catalyst in the saccharification step, thereby promoting the saccharification reaction in the saccharification step.

Moreover, the inventors found that the crystallinity of cellulose in the plant fiber material decreases in the immersion step due to the action of the dissolved cluster acid. The decrease in crystallinity enhances the saccharification reactivity of cellulose. In addition, the inventors found that a portion of amorphous cellulose is hydrolyzed and saccharified in the immersion step. As has been described above, the pretreatment method according to the embodiments enables contact of the plant fiber material with saccharification catalyst and water to be significantly improved in the saccharification step by decomposing and removing pectin and by lowering the crystallinity of cellulose. In addition, cellulose and hemicellulose can be solubilized, or in other words, cellulose and hemicellulose can be converted to cellooligosaccharides (in which 10 or fewer glucose molecules are linked). Moreover, according to the pretreatment method according to the embodiments, a portion of cellulose can be saccharified prior to the saccharification step. Thus, according to the embodiments, the saccharification step can be shortened and milder reaction conditions, such as a lower reaction temperature, can be used, while also improving the saccharification rate.

The pretreated mixture obtained in the distillation step following the immersion step by distilling off organic solvent used to dissolve the cluster acid can be loaded to the saccharification step either directly or after adding components required for saccharification or removing the cluster acid as necessary.

The following provides a detailed explanation of the pretreatment method for saccharification of plant fiber materials and the saccharification method according to embodiments of the invention. Furthermore, this explanation focuses on a saccharification method that uses a cluster acid for the saccharification catalyst in the saccharification step. The pretreatment method according to embodiments of the invention is at least provided with an immersion step and a distillation step. An explanation is first provided of a step in which a plant fiber material is immersed in an organic solvent solution of a cluster acid that at least contains a cluster acid and an organic solvent in which the cluster acid is soluble (immersion step).

There are no particular limitations on the plant fiber material provided it contains cellulose and hemicellulose, examples of which include cellulose-based biomass (plant fiber) such as that of deciduous trees, bamboo, coniferous trees, kenaf, furniture waste materials, rice straw, wheat straw, rice husks, bagasse or sugar cane draff. In addition, the plant fiber material may also be cellulose or hemicellulose separated from the above-mentioned biomass or artificially synthesized cellulose or hemicellulose. In the embodiments, a high saccharification rate and shortened saccharification process can be realized even in the case of naturally-occurring plant fibers listed above as examples of cellulose-based biomass. These plant fiber materials are normally used in the form of powders from the viewpoint of dispersibility in the reaction system. The method used to obtain powder may be that which complies with ordinary methods. In the embodiments, since the opportunities for contact between the cluster acid and plant fiber material in the saccharification step are increased in the pretreatment steps, high reaction rates can be achieved even for plant fiber materials having a diameter of 50 μm or more. The plant fiber material is preferably in the form of a powder that has a diameter of about several μm to 1 mm from the viewpoint of improving mixability and increasing opportunities for contact with the cluster acid.

In addition, the plant fiber material may undergo preliminary digestion treatment as necessary to dissolve lignin contained therein. Dissolving and removing lignin makes it possible to increase the opportunities for contact between the cluster acid and cellulose in the saccharification step, while at the same time reducing the amount of residue contained in the saccharification reaction mixture, thereby making it possible to inhibit decreases in saccharification rate and decreases in cluster acid recovery rate caused by contamination by produced sugars and cluster acid present in the residue. In the case of carrying out digestion treatment, the effects of being able to reduce labor, costs and energy for converting the fiber material to a powder can be achieved since the degree of fragmentation of the plant fiber material can be made to be comparatively low (coarse fragmentation). Examples of digestion treatment include a method in which the plant fiber material (that has a diameter of about several cm to several mm) is contacted in the presence of steam with a base, salt or aqueous solution thereof, such as NaOH, KOH, $Ca(OH)_2$, $Na_2SO_3$, $NaHCO_3$, $NaHSO_3$, $Mg(HSO_3)_2$ or $Ca(HSO_3)_2$, a solution obtained by further mixing these with an $SO_2$ solution, or a gas such as $NH_3$. Specific conditions for this treatment consist of a reaction temperature of 120 to 160° C. and reaction time of about several tens of minutes to 1 hour.

A homopoly acid or heteropoly acid may be used for the cluster acid used in the embodiments, and a heteropoly acid is preferable. There are no particular limitations on the heteropoly acid, and example there is that represented by the general formula: HwAxByOz (wherein, A represents a heteroatom, B represents a polyatom serving as the backbone of a polyacid, w represents the composite ratio of hydrogen atoms, x represents the composite ratio of hetero atoms, y represents the composite ratio of polyatoms, and z represents the composite ratio of oxygen atoms). Examples of the polyatom B include atoms such as W, Mo, V or Nb that are capable of forming a polyacid. Examples of the heteroatom A include atoms such as P, Si, Ge, As or B that are capable of forming a heteropoly acid. One type or two or more types of polyatoms and heteroatoms may be contained within a single heteropoly acid molecule.

Tungstic acids such as phosphotungstic acid ($H_3[PW_{12}O_{40}]$) or silicotungstic acid ($H_4[SiW_{12}O_{40}]$) may be preferably used as heteropoly acids, while molybdic acids such as phosphomolybdic acid ($H_3[PMo_{12}O_{40}]$) or silicomolybdic acid ($H_4[SiMo_{12}O_{40}]$) may also be used. In addition, substituted forms in which all or a portion of their hydrogens are substituted may also be used.

Figure 1B:
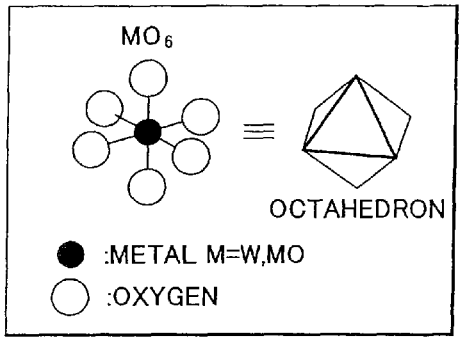

The structure of Keggin-type heteropoly acids ($[X^{n+}M_{12}O_{40}:]^{n+}$ (wherein, X represents, for example, P, Si Ge or As, and M represents, for example, Mo or W) (phosphotungstic acid) is shown in FIG. 1. A tetrahedron $XO_4$ is present in the center of a polyhedron composed of octahedron $MO_6$ units, and a large amount of crystallization water is present around this structure. Furthermore, there are no particular limitations on the structure of the cluster acid, may be of the Dawson type in addition to the Keggin type described above. In the embodiments, "crystallization water" refers to water that hydrates or coordinates with a crystalline cluster acid or clustered cluster acid composed of several molecules of cluster acid. This crystallization water includes anionic water, in which water is hydrogen-bonded with anions that compose the cluster acid, coordinated water that is coordinated with cations, lattice water, which is not coordinated with anions or cations, and water contained in the form of OH groups. In addition, clustered cluster acids refer to aggregates composed of one to several molecules of cluster acid and differ from crystals. Cluster acids can be put into a clustered state in the form of a solid, pseudo-melt or when dissolved in a solvent (including a colloidal state).

Although cluster acids as described above are solids at normal temperatures, they become a pseudo-melt when the temperature thereof is raised by heating, and together with acting as saccharification catalysts that demonstrate catalytic activity for cellulose and hemicellulose saccharification reactions (hydrolysis reactions), also act as reaction solvents. Here, a pseudo-molten state refers to that which appears to be melted, but is actually not in a completely molten liquid state, and which demonstrates fluidity in a state that approximates that of a colloid (sol) in which the cluster acid is dispersed in a liquid. Whether or not a cluster acid is in a pseudo-molten state can be confirmed visually, or in the case of a homogeneous system, can be confirmed with a differential thermal gravimeter (DTG). A pseudo-molten state of a cluster acid changes according to temperature and the amount of crystallization water contained by the cluster acid (see FIG. 2). More specifically, in the case of the cluster acid, phosphotungstic acid, the temperature at which the cluster acid demonstrates a pseudo-molten state decreases as the amount of crystallization water contained therein increases. Namely, cluster acids that contain large amounts of crystallization water demonstrate catalyst activity for cellulose saccharification reactions at lower temperatures than cluster acids containing relatively smaller amounts of crystallization water. In other words, a cluster acid can be put into a pseudo-molten state at a pseudo-melting temperature by controlling the amount of crystallization water contained by the cluster acid in a reaction system of a saccharification step. For example, in the case of using phosphotungstic acid, the saccharification reaction temperature can be controlled to within a range of 110 to 40° C. depending on the amount of crystallization water (see FIG. 2).

Figure 2:
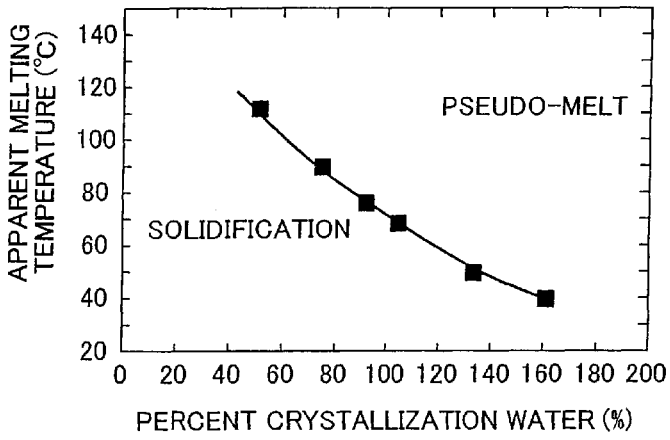
FIG. 2 shows a graph illustrating the relationship between percentage crystallization water and apparent melting temperature.

Furthermore, FIG. 2 illustrates the relationship between percent crystallization water of a typical cluster acid in the form of a heteropoly acid (phosphotungstic acid) and the temperature at which the cluster acid begins to demonstrate a pseudo-molten state (apparent melting temperature). The cluster acid is a pseudo-solid state in the region below the curve and in a pseudo-molten state in the region above the curve. In addition, in FIG. 2, percent crystallization water (%) refers to the value based on a value of 100% for the standard amount of crystallization water n (n=30) of the cluster acid (phosphotungstic acid). Since cluster acids do not contain components that undergo thermal decomposition and volatilize even at a high temperature of 800° C., the amount of crystallization water of cluster acids can be determined by a thermal decomposition method, for example, thermogravimetric (TG) measurement.

Here, standard amount of crystallization water refers to the amount (number of molecules) of crystallization water contained by a single cluster acid molecule in a solid state at room temperature, and varies according to the type of cluster acid. For example, the standard amount of crystallization water of phosphotungstic acid is about 30 [$H_3[PW_{12}O_{40}].nH_2O$ ($n \cong 30$)], that of silicotungstic acid is about 24 [$H_4[SiW_{12}O_{40}]. nH_2O$ ($n \cong 24$)], and that of phosphomolybdic acid is about 30 [$H_3[PMo_{12}O_{40}].nH_2O$ ($n \cong 30$)].

The amount of crystallization water contained by a cluster acid can be adjusted by controlling the amount of moisture present in the saccharification reaction system. More specifically, in the case of desiring to increase the amount of crystallization water of a cluster acid, or in other words, lowering the saccharification reaction temperature, water is added to the hydrolysis reaction system such as by adding water to the mixture containing plant fiber material and cluster acid or by increasing the relative humidity of the atmosphere of the reaction system. As a result, the cluster acid incorporates the added water as crystallization water, and the apparent melting temperature of the cluster acid decreases.

On the other hand, in the case of desiring to decrease the amount of crystallization water of a cluster acid, or in other words, raising the saccharification reaction temperature, the amount of crystallization water of the cluster acid can be reduced by removing water from the saccharification reaction system such as by heating the reaction system to evaporate water, or adding a desiccant to the mixture containing plant fiber material and cluster acid. As a result, the apparent melting temperature of the cluster acid increases. As has been described above, the amount of crystallization water of a cluster acid can be easily controlled, and the cellulose saccharification reaction temperature can also be easily adjusted by controlling the amount of crystallization water.

In addition, cluster acids also demonstrate enzymatic activity for cellulose and hemicellulose saccharification reactions not only in a pseudo-molten state, but also when dissolved in an organic solvent. In this case of using a dissolved cluster acid in this manner, the amount of cluster acid used can be reduced in comparison with the case of using a pseudo-molten cluster acid while maintaining saccharification reactivity of the cellulose contained in the plant fiber material due to the high levels of mixability and contactability between the cluster acid and plant fiber material. Namely, the amount of cluster acid per unit weight of monosaccharide formed can be decreased, thereby making it possible to reduce sugar production costs.

In the embodiments, a cluster acid that demonstrates catalytic activity for saccharification reactions of cellulose and hemicellulose as described above is used for pretreating a saccharification raw material in the form of a plant fiber material. More specifically, a plant body material is immersed in an organic solvent solution of a cluster acid that contains a cluster acid and an organic solvent capable of dissolving the cluster acid (immersion step). There are no particular limitations on the organic solvent capable of dissolving the cluster acid in which the plant fiber material is immersed (to be referred to as the immersion solvent) provided that it dissolves the cluster acid and can be removed by distillation in the following distillation step. More specifically, the solubility of the cluster acid in the immersion solvent may be 100 g/100 ml or more, and particularly 200 g/100 ml or more. In addition, from the viewpoint of distillation efficiency in the distillation step, the boiling point of the immersion solvent may be 100° C. or lower, and particularly 80° C. or lower. Furthermore, the boiling point of the immersion solvent may be 30° C. or higher, and particularly 50° C. or higher. In addition, the boiling point of the immersion solvent may be 100° C. or lower.

Ethanol may be used for the immersion solvent according to the embodiments. The solubility of typical cluster acids in the form of heteropoly acids in ethanol is extremely high, and the boiling point of ethanol is 78° C., which is within the range of 50 to 100° C. Examples of immersion solvents that may be used include alcohols such as methanol or n-propanol in addition to ethanol, and ethers such as diethyl ether or diisopropyl ether.

There are no particular limitations on the concentration of cluster acid in the immersion solvent, and although varying according to the cluster acid and immersion solvent used, may be 50 g/100 ml or more, particularly 100 g/100 ml or more, and more particularly 200 g/ml or more, from the viewpoint of reaction rate. On the other hand, from the viewpoints of cost and ease of separation, the concentration of cluster acid in the immersion solvent may normally be 400 g/100 ml or less, and more particularly 200 g/ml or less. In addition, there are no particular limitations on the ratio between the plant fiber and cluster acid in the immersion step, and may be suitably determined. More specifically, although varying according to the properties (such as size) and type of the plant fiber material used, the type of cluster acid and the like, the ratio of cluster acid to plant fiber material (weight ratio) may be within the range of 1:2 to 3:1 and preferably within the range of 1:2 to 2:1.

Components other than the cluster acid and immersion solvent may be added as necessary to the organic solvent solution of the cluster acid in which the cluster acid is dissolved in the immersion solvent. For example, all or a portion of the water for hydrolysis required for saccharification of the plant fiber material in the saccharification step may be added to the organic solvent solution of the cluster acid. At this time, an immersion solvent that has a boiling point lower than the boiling point of water is used so that water for hydrolysis is not removed with the immersion solvent in the distillation step. Since saccharification of the amorphous portion of cellulose also occurs in the immersion step as previously described, saccharification of cellulose and the like in the immersion step can be promoted by containing water in the organic solvent solution of the cluster acid. Although there are no particular limitations on the amount of water for hydrolysis that is added, since energy efficiency of the saccharification reaction decreases if added in excess, the amount of water added is that which does not exceed the amount of water required for saccharification of cellulose and hemicellulose in the plant fiber material loaded in the saccharification step and for putting the cluster acid in a pseudo-molten state.

The immersion step can be carried out over a temperature range from room temperature (usually 15 to 25° C.) to 40° C. This is because, since the action of dissolved cluster acid on the plant fiber material in the immersion step is sufficiently strong even under comparatively low temperature conditions as previously described, adequate effects can be obtained without any substantial heating. The immersion step may be carried out a temperature in the vicinity of room temperature from the viewpoints of energy efficiency and the like. Here, the temperature of the immersion step refers to the temperature of the organic solvent solution in which the cluster acid is dissolved. In addition, although there are no particular limitations on the immersion time of the plant fiber material in the organic solvent solution of the cluster acid, it is normally about 2 days to 2 months, and may be about 2 to 7 days.

The immersion step typically consists of immersing the plant fiber material in the organic solvent solution of the cluster acid, and after suitably stirring for about 10 to 60 minutes, allowing to stand for the immersion time indicated above. Although stirring may be continued throughout the immersion step, in the case of using an organic solvent such as ethanol that demonstrates superior solubility with respect to ethanol for the immersion solvent, adequate effects are obtained by simply allowing to stand without stirring, thereby resulting in favorable energy efficiency.

Following completion of the immersion step, the immersion solvent is distilled off (distillation step). In the distillation step, a conventional method can be employed to distill off the immersion solvent. For example, the immersion solvent may be distilled off by atmospheric distillation or vacuum distillation, and preferably distilled off by vacuum distillation. The cluster acid and plant fiber material that has been treated with the cluster acid are at least contained in the pretreated mixture obtained by distilling off the immersion solvent. In the case saccharification of the amorphous portion of cellulose has occurred in the immersion step, the sugar that was formed is contained in the pretreated mixture. In addition, in the case of adding water for hydrolysis, the water is also contained in the pretreated mixture.

In the case of using a cluster acid as a saccharification catalyst in the saccharification step, the pretreated mixture obtained following completion of the distillation step can be loaded into the saccharification step as a raw material of the saccharification step. In addition, in the case of using a saccharification catalyst other than cluster acid in the saccharification step, the pretreated mixture can be used as a raw material of the saccharification step by removing the cluster acid. Methods similar to those used in the separation step to be described later can be used to remove the cluster acid. More specifically, the pretreated mixture can be separated into a solution containing dissolved cluster acid and a solid containing the pretreated plant fiber material, formed sugars and the like by adding a solvent that is a good solvent with respect to the cluster acid catalyst and a poor solvent with respect to sugar and then separating the solid and liquid. The following provides an explanation of a saccharification step in which a cluster acid is used for the saccharification catalyst.

Furthermore, although the explanation focuses primarily on a step in which glucose is formed mainly from cellulose, hemicellulose is also contained in the plant fiber material in addition to cellulose, and the products consist of other monosaccharides such as xylose in addition to glucose, and the invention can be applied to these as well.

In the saccharification method according to the embodiments of the invention, a pretreated mixture obtained according to the above-mentioned pretreatment method is loaded in the saccharification step, and cellulose contained in the pretreated plant fiber material present in the pretreated mixture is hydrolyzed resulting in the formation of monosaccharide. Additional plant fiber material or cluster acid may be added to the pretreated mixture.

As has been previously described, cluster acids demonstrate catalytic activity for cellulose saccharification reactions whether in a pseudo-molten state or dissolved state. In the case of using a cluster acid in the form of a pseudo-melt, the ratio between the plant fiber material and the cluster acid varies according to such factors as the properties (such as size) and type of plant fiber material used, and the stirring method and mixing method employed in the saccharification step. Consequently, although this ratio is suitably determined corresponding to the conditions under which the saccharification step is carried out, the ratio of cluster acid to plant fiber material (weight ratio) may be within the range of 1:1 to 4:1, particularly within the range of 1:1 to 3:1. Although this ratio varies according to the mixing method, in consideration of energy costs, the amount of cluster acid is preferably as low as possible. In addition, in the case of adding an additional plant fiber material or cluster acid to the pretreated mixture, the weight of each of the cluster acid and plant fiber material in the ratio of cluster acid to plant fiber material is such that the total amount of the plant fiber material that has undergone pretreatment and the charged amount of the added plant fiber material is taken to be the weight of the plant fiber material, and the total amount of cluster acid used for pretreatment and the amount of cluster acid added is taken to be the weight of the cluster acid, while in the case of using only the pretreated mixture, the weight of the plant fiber material is taken to be the weight of the plant fiber material that has undergone pretreatment and the weight of the cluster acid is taken to be the weight of the cluster acid used for pretreatment.

Since a pseudo-molten cluster acid also functions as a reaction solvent, water or organic solvent is not required to be used as a reaction catalyst in the saccharification step, although varying according to such factors as the form (such as size and fiber status) of the plant fiber material and the mixing ratio and volume ratio of the cluster acid and plant fiber material.

On the other hand, in the case of using a dissolved cluster acid, namely in the case of using an organic solvent capable of dissolving a cluster acid in the form of a reaction solvent and dissolving the cluster acid in the organic solvent, although the organic solvent (which may also be referred to as the reaction solvent) must be able to dissolve the cluster acid at least at the reaction temperature of the saccharification reaction (hydrolysis), an organic solvent is normally used that is able to dissolve the cluster acid at a temperature equal to or lower than the reaction temperature of the saccharification reaction, typically at room temperature as well. More specifically, the solubility of cluster acid may be 50 g/100 ml or more, particularly 250 g/100 ml or more, and more particularly 500 g/100 ml or more. The reaction solvent may have a boiling point that is higher than the reaction temperature in the saccharification step from the viewpoint of inhibiting evaporation of reaction solvent in the saccharification step. More specifically, the boiling point of the reaction solvent may be 90° C. or higher, particularly 125° C. or higher, and more particularly 150° C. or higher.

In addition, glucose and other sugars are poorly soluble in the reaction solvent in order to enhance sugar separation efficiency in the sugar separation step that follows the saccharification step. Since a formed sugar precipitates in the reaction solvent during the saccharification step in the case the sugar is poorly soluble in the reaction solvent, by carrying out solid-liquid separation by filtration and the like on the saccharification reaction mixture (containing formed sugar, cluster acid, reaction solvent, and depending on the case, residue and the like) obtained following the saccharification step, a liquid component containing the cluster acid and the reaction solvent can be separated from a solid component that contains the sugar. Here, an organic solvent in which sugar is poorly soluble refers to that in which solubility of sugar with respect to the organic solvent is 1 g/100 ml or less, preferably 0.2 g/100 ml or less and more preferably 0.1 g/100 ml or less. The sugar may be most preferably insoluble (solubility of 0 g/100 ml) in the reaction solvent.

Examples of organic solvents in which cluster acid is soluble and sugar is poorly soluble include polar organic solvents, and more specifically, polar organic solvents that have a specific dielectric constant of 8 or more, and more particularly, polar organic solvents that have a specific dielectric constant of 8 to 18. In consideration of the above, a polar organic solvent that has a boiling point higher than the saccharification reaction temperature and in which sugar is poorly soluble is preferable for use as the reaction solvent. More specifically, a polar organic solvent that has a boiling point of 90° C. or higher and a specific dielectric constant of 8 to 18 is preferable.

Although there are no particular limitations on the reaction solvent, examples include alcohols that have 6 to 10 carbon atoms (which may be linear or branched), and from the viewpoint of ignitability, alcohols that have 8 to 10 carbon atoms may be used. Specific examples of alcohols that may be used include 1-hexanol, 1-heptanol, 2-heptanol, 1-octanol, 2-octanol, 1-decanol and 1-nonanol, with 1-octanol, 2-octanol, 1-decanol and 1-nonanol being used preferably, and 1-octanol and 2-octanol being used particularly preferably.

In the case of using a cluster acid by dissolving in a reaction solvent in the saccharification step, the ratio of the plant fiber material and cluster acid varies according to the properties of the plant fiber material used (such as size and type of fiber material), the stirring method used in the saccharification step, and the amount of reaction solvent used and the like. Consequently, the ratio of plant fiber material and cluster acid is suitably determined corresponding to the conditions under which the saccharification reaction is carried out. More specifically, for example, the ratio of cluster acid to plant fiber material (weight ratio) may be within the range of 1:4 to 1:1, and particularly within the range of 1:4 to 1:2. Although this ratio varies according to the mixing method, in consideration of energy costs, the ratio of the cluster acid is preferably as low as possible. In addition, the weights of the cluster acid and plant fiber material in the ratio thereof are the same as in the case of using a pseudo-molten cluster acid. In addition, in the case of using a cluster acid by dissolving in a reaction solvent, the cluster acid may be dissolved in the reaction solvent after preliminarily mixing the pretreated reaction mixture and the reaction solvent.

Cluster acids demonstrate high catalytic activity for cellulose and hemicellulose saccharification reactions even at low temperature due to the potent acid strength thereof as previously described. In addition, since cluster acids have a diameter of about 1 to 2 nm, they demonstrate superior mixability with the raw material in the form of the plant fiber material; thereby making it possible to efficiently promote cellulose saccharification reactions. Thus, cellulose can be saccharified under mild conditions resulting in high energy efficiency and a smaller burden on the environment. Moreover, in the case of using a cluster acid as a catalyst, the separation efficiency of the sugar and catalyst can be improved thereby making it possible to facilitate separation. Since cluster acids may be solids depending on the temperature, they can be from sugars formed as products of the saccharification reaction. Thus, the separated cluster acid can be recovered and reused. Namely, as a result of using a cluster acid as a cellulose saccharification catalyst, the invention makes it possible to reduce costs associated with saccharification and separation of plant fiber materials while also placing a small burden on the environment.

Water is required in the saccharification step since the cellulose undergoes hydrolysis. More specifically, (n−1) water molecules are required to decompose cellulose in which n molecules of glucose are polymerized into n molecules of glucose. Thus, at least an amount of water is added to the saccharification reaction system that is required to hydrolyze the entire amount of cellulose contained in the plant fiber material to glucose. Water is preferably added in an amount equal to the minimally required amount for hydrolyzing the entire amount of cellulose loaded as plant fiber material into glucose. This is because excess addition of water causes excess amounts of sugar formed and cluster acid to be dissolved in the water, thereby making the sugar separation step excessively complex. On the other hand, in the case of using a pseudo-molten cluster acid, if the total of the amount of crystallization water required for putting the cluster acid into a pseudo-molten state at the reaction temperature and the amount of water required for the crystallization water of the cluster acid to hydrolyze the cellulose is not present in the reaction system, the amount of crystallization water of the cluster acid decreases thereby causing the cluster acid to enter a coagulated state. Namely, not only does contactability between the plant fiber material and cluster acid decrease, but the viscosity of the mixture of plant fiber material and cluster acid increases, thereby requiring considerable time to adequately mix the mixture.

There are no particular limitations on the time at which the water is added. For example, all or a portion of the water may be added to the organic solvent solution of cluster acid at the time of pretreatment as previously described, or all or a portion of the water may be added to the pretreated mixture in the saccharification step. Furthermore, water may also be added to ensure an adequate amount of water required for saccharification of glucose even if the relative humidity of the reaction system decreases due to heating. More specifically, a saturated water vapor state may be created at the saccharification reaction temperature within a preliminarily sealed reaction vessel for example, and the steam may be condensed by lowering the temperature while keeping the reaction vessel sealed so that the atmosphere of the reaction system at the scheduled reaction temperature reaches the saturated vapor pressure.

Lowering the reaction temperature in the saccharification step offers the advantage of being able to improve energy efficiency. In addition, selectivity of glucose formation during hydrolysis of glucose contained in the plant fiber material changes according to the temperature of the saccharification step. Reaction rate typically increases as the reaction temperature becomes higher, and as reported in JP-A-2008-271787, for example, reaction rate R at 50 to 90° C. increases with rising temperatures even in a cellulose saccharification reaction that uses phosphotungstic acid having percent crystallization water of 160%, and nearly all of the cellulose reacts at about 80° C. On the other hand, although glucose yield demonstrates an increasing trend at 50 to 60° C. in the same manner as the reaction rate of cellulose, it begins to decrease after peaking at 70° C. Namely, in contrast to glucose being formed highly selectively at 50 to 60° C., reactions other than those involving glucose formation, such as the formation of other sugars such as xylose and the formation of decomposition products, proceed at 70 to 90° C. Thus, the saccharification reaction temperature is an important factor that influences the reaction rate of cellulose and the selectivity of glucose formation, and although the saccharification reaction temperature is preferably low from the viewpoint of energy efficiency, the saccharification reaction temperature is also determined in consideration of cellulose reaction rate, glucose formation selectivity and the like.

Although the reaction conditions in the saccharification step may be suitably determined in consideration of the several factors listed above (such as reaction selectivity, energy efficiency or cellulose reaction rate), the reaction temperature is normally 140° C. or lower and particularly 120° C. or lower based on the balance between energy efficiency, cellulose reaction rate and glucose yield, and may be a low temperature of 100° C. or lower depending on the form of the plant fiber material. Moreover, since reactivity of cellulose in the plant fiber material and opportunities for contact between the cellulose and cluster acid are enhanced by pretreatment in the embodiments, the reaction temperature can be lowered to 70 to 90° C. or further lowered to 50 to 90° C.

In addition, although there are no particular limitations on the pressure in the saccharification step, since the catalytic activity of cluster acid with respect to the cellulose saccharification reaction is high, hydrolysis of cellulose is able to proceed efficiently even under mild pressure conditions of normal pressure (atmospheric pressure) to 1 MPa.

Since the mixture containing cluster acid and plant fiber material in the saccharification step has high viscosity, a method that uses a heated ball mill, for example, is preferable for the stirring method, although stirring may also be carried out with an ordinary stirrer.

There are no particular limitations on the duration of the saccharification step, and it may be suitably set according to, for example, the form of plant fiber material used, the ratio between the plant fiber material and the cluster acid, catalytic activity of the cluster acid, reaction temperature or reaction pressure. The reaction time can be shortened since saccharification reactivity of cellulose in the plant fiber material and opportunities for contact between cellulose and cluster acid are enhanced by pretreatment in the saccharification method according to the embodiments. More specifically, the duration of the saccharification step can be shortened by half in comparison with the case of using a plant fiber material without carrying out pretreatment according to the pretreatment method according to the embodiments of the invention.

If the temperature of the reaction system is lowered following completion of the saccharification step, sugar that has been formed in the saccharification step is contained in the saccharification reaction mixture in the form of an aqueous sugar solution in the case water is present that dissolves the sugar, or in the case water that dissolves the sugar is not present, is contained in the saccharification reaction mixture in a solid state. A portion of the sugar formed is contained in an aqueous sugar solution, while the remainder is contained in the saccharification reaction mixture in a solid state. On the other hand, the cluster acid also becomes a solid (in the case of using in a pseudo-molten state) as a result of lowering the temperature, or is dissolved in the reaction solvent (in the case of using by dissolving in the reaction solvent). Furthermore, since the cluster acid also has water solubility, the cluster acid also dissolves in water depending on the water content of the mixture following the saccharification step. In addition, the saccharification reaction mixture also contains solids in the form of residue (unreacted cellulose, lignin and the like) depending on the pretreatment conditions, conditions of the saccharification step and plant fiber material used.

The resulting saccharification reaction mixture can be separated into the sugar formed (mainly glucose) and the cluster acid by a sugar separation step as described below. Furthermore, the sugar separation step is explained by dividing into a case in which the cluster acid is used in a pseudo-molten state in the saccharification step, and a case in which it is used by dissolving in the reaction solvent. Furthermore, the method used to separate sugar and cluster acid is not limited to the method described below.

First, an explanation is provided of the case of using the cluster acid in a pseudo-molten state. Cluster acids demonstrate solubility in organic solvents for which sugars consisting mainly of glucose are poorly soluble to insoluble. For this reason, the saccharification reaction mixture can be separated into a organic solvent solution containing dissolved cluster acid (liquid component) and a solid component containing sugar by carrying out solid-liquid separation after adding an organic solvent, which is a poor solvent for sugar and a good solvent for the cluster acid (to be referred to as a separation solvent), stirring and selectively dissolving the cluster acid in the organic solvent. The solid component that contains the sugar also contains residue and the like according to the plant fiber material used, conditions in the saccharification step, pretreatment conditions and the like. There are no particular limitations on the method used to separate the organic solvent solution and the solid component, and ordinary solid-liquid separation methods, such as decantation or filtration, can be used.

Although there are no particular limitations on the separation solvent provided that it has dissolution characteristics such that it is a good solvent for the cluster acid and poor solvent for sugar, the solubility of sugar in the separation solvent may be 0.6 g/100 ml or less and particularly 0.06 g/100 ml or less in order to inhibit the sugar from dissolving in the separation solvent. At this time, the solubility of the cluster acid in the separation solvent may be 20 g/100 ml or more and particularly 40 g/100 ml or more in order to increase the recovery rate of the cluster acid.

Specific examples of the separation solvent include alcohols such as ethanol, methanol, n-propanol or octanol, and ethers such as diethyl ether or diisopropyl ether. Alcohols and ethers can be used preferably, and from the viewpoints of solubility and boiling point, ethanol and diethyl ether are particularly preferable. Since sugars such as glucose are insoluble in diethyl ether while the solubility of cluster acid therein is high, diethyl ether is one of the best solvents for separating the sugar and cluster acid. On the other hand, since sugars such as glucose are also poorly soluble in ethanol while the solubility of cluster acid therein is also high, ethanol is also one of the best solvents. Diethyl ether is advantageous to ethanol with respect to distillation, while ethanol offers the advantage of being more readily available than diethyl ether.

Since the amount of the separation solvent used varies according to the dissolution characteristics of the organic solvent with respect to sugar and cluster acid, the amount of water contained in the saccharification reaction mixture and the like, a suitable amount is determined for the amount of separation solvent used. Although varying according to such factors as the boiling point of the separation solvent, stirring of the saccharification reaction mixture and the separation solvent may normally be carried out within the range of room temperature to 60° C. In addition, there are no particular limitations on the method used to stir the saccharification reaction mixture and the separation solvent, and ordinary methods may be used. Stirring and crushing using a ball mill and the like are preferable for the stirring method from the viewpoint of recovery rate of the cluster acid.

The solid component obtained by solid-liquid separation can be separated into an aqueous sugar solution and a solid component that contains residue and the like by additional solid-liquid separation since the sugar dissolves in water as a result of adding water such as distilled water and stirring. The separation solvent may additionally be added to the solid component followed by stirring and washing with the separation solvent to improve the recovery rates of sugar and cluster acid and enhance the purity of the resulting sugar (see FIG. 5). This is because the addition of separation solvent allows cluster acid present in the solid component to be removed and recovered. A mixture in which the distillation solvent has been added to the solid component can be separated into the solid component and an organic solvent solution of the cluster acid by solid-liquid separation in the same manner as the saccharification reaction mixture. Washing of the solid component with the separation solvent can be carried out multiple times as necessary (see FIG. 5).

On the other hand, the liquid component obtained by the above-mentioned solid-liquid separation (in which the cluster acid is dissolved in the separation solvent) can be separated into the cluster acid and separation solvent by removing the separation solvent, thereby enabling recovery of the cluster acid. There are no particular limitations on the method used to remove the separation solvent, a method such as vacuum distillation or freeze-drying may be used, and vacuum distillation may be used preferably. The recovered cluster acid can again be used as a saccharification catalyst of the plant fiber material. After washing the solid component, the recovered separation solvent (containing dissolved cluster acid) can also again be used to wash the solid component. Alternatively, the liquid component obtained by the above-mentioned solid-liquid separation (in which the cluster acid is dissolved in the separation solvent) can also be used as an organic solvent solution of the cluster acid in the pretreatment method according to the embodiments of the invention in the case the separation solvent can also be used as the previously described immersion solvent. In this case, it is not necessary to separate the cluster acid and the separation solvent, thereby making it possible to further improve the efficiency of plant fiber material saccharification.

Furthermore, an aqueous solution containing dissolved sugar and cluster acid may be contained in the saccharification reaction mixture depending on the moisture content in the saccharification step. In this case, for example, after precipitating the dissolved sugar and cluster acid by removing the water from the saccharification reaction mixture, the aqueous solution can be separated into a solid component that contains the sugar and an organic solvent that contains the dissolved cluster acid by adding the separation solvent, stirring and carrying out solid-liquid separation. The amount of water in the saccharification reaction mixture may be particularly preferably adjusted so that the percent crystallization water of all of the cluster acid contained in the saccharification reaction mixture is less than 100%. In the case the cluster acid has a large amount of crystallization water, and typically an amount of crystallization water equal to or greater than the standard amount of crystallization water, product in the form of sugar dissolves in the excess water and sugar ends up being contained in the organic solvent solution of the cluster acid, thereby causing a decrease in the sugar recovery rate. Sugar can be inhibited from contaminating the cluster acid in this manner by making the percent crystallization water of the cluster acid less than 100%.

The method used to lower the percent crystallization water of the cluster acid contained in the saccharification reaction mixture may be any method capable of lowering the moisture content of the saccharification reaction mixture, examples of which include a method in which moisture in the hydrolysis mixture is evaporated by releasing the sealed state of the reaction system and heating, and a method in which moisture in the hydrolysis mixture is removed by adding a desiccant to the hydrolysis mixture.

Next, an explanation is provided of the case of using the cluster acid dissolved in the reaction solvent. The formed sugar precipitates in the saccharification reaction mixture due to the use of an organic solvent in which sugar is poorly soluble for the reaction solvent. On the other hand, since the cluster acid is soluble in the reaction solvent, the saccharification reaction mixture can be separated into a solid component that contains the formed sugar and a liquid component that contains the cluster acid and reaction solvent by subjecting the saccharification reaction mixture to solid-liquid separation. Residue and the like are contained in the solid component that contains the formed sugar depending on the plant fiber material used. There are no particular limitations on the method used to separate the saccharification reaction mixture into the solid component and the liquid component, and an ordinary solid-liquid separation such as decantation or filtration can be used.

The solid component obtained by solid-liquid separation can be separated into an aqueous sugar solution and a solid component that contains residue and the like by additional solid-liquid separation since the sugar dissolves in water as a result of adding water such as distilled water and stirring. On the other hand, the liquid component obtained by solid-liquid separation can again be used for the saccharification catalyst and reaction solvent of the plant fiber material in the form of an organic solvent solution of the cluster acid in which the cluster acid is dissolved in the reaction solvent.

In the sugar separation step, by adding an organic solvent, which is compatible with the reaction solvent, demonstrates higher solubility for the cluster acid than the reaction solvent and has a lower boiling point than the reaction solvent (to be referred to as the washing solvent) to the saccharification reaction mixture, stirring and using a means such as filtration, the recovery rate of the cluster acid can be increased and the purity of the resulting sugar can be enhanced by solid-liquid separation of the saccharification reaction mixture into a liquid component that contains the cluster acid, reaction solvent and washing solvent and a solid component that contains the sugar. First, by adding the washing solvent, which is compatible with the reaction solvent and demonstrates higher solubility for the cluster acid than the reaction solvent, a larger amount of the cluster acid can be dissolved in an organic phase (liquid phase) that contains the reaction solvent and the washing solvent. As a result, the recovery rate of the cluster acid and the purity of the sugar can be improved. In addition, as a result of the boiling point of the washing solvent being lower than that of the reaction solvent, washing solvent and the organic solvent solution of the cluster acid in which the cluster acid is dissolved in the reaction solvent can be separated by distilling the liquid component that contains the cluster acid and organic solvent (reaction solvent and washing solvent) that has been separated and recovered from the saccharification reaction mixture. At this time, an ordinary method such as vacuum distillation or filtration may be used for the distillation method, and vacuum distillation may be used preferably.

Although there are no particular limitations on the washing solvent provided it has the characteristics indicated above, ethanol may be used particularly preferably. The solubility of typical cluster acids in the form of heteropoly acids is extremely high in ethanol, and ethanol is highly effective for improving the recovery rate of the heteropoly acid and the purity of the sugar. In addition to ethanol, other examples of washing solvents that can be used include alcohols such as methanol or n-propanol and ethers such as diethyl ether or diisopropyl ether.

The solid component obtained by solid-liquid separation of the saccharification reaction mixture to which the washing solvent has been added may be separated into the washing solvent that contains the dissolved cluster acid contained in the solid component and a solid component that contains the sugar by again adding the washing solvent, mixing, washing and carrying out solid-liquid separation. Furthermore, washing of the solid component with the washing solvent can be carried out multiple times as necessary. After washing the solid component, the recovered washing solvent can also be used again to wash the solid component. The moisture content of the saccharification reaction mixture may also be adjusted so that the percent crystallization water of all of the cluster acid contained in the saccharification reaction mixture is less than 100% even in the case of having used the cluster acid dissolved in the reaction solvent. The specific method is the same as in the case of using a pseudo-molten cluster acid.

The following provides an explanation of Example 1 of the invention. Phosphotungstic acid (heteropoly acid) was prepared by preliminarily adjusting the moisture content to be a crystallization water 30 by moisture absorption and drying. A solution was prepared by dissolving this phosphotungstic acid in guaranteed reagent grade ethanol to a concentration of 236 g/100 ml of ethanol. Next, 1 kg of plant fiber material in the form of crushed cedar (150 μm or less, moisture content: 4%) was placed in a reactor equipped with a stirrer. Moreover, about 1 L of the previously prepared phosphotungstic acid ethanol solution was added followed by mixing for about 10 minutes. Moisture was confirmed to have spread throughout the mixture. The mixture was allowed to stand for 2 days and 7 days at room temperature. After 2 days and 7 days, ethanol was distilled from the mixture by vacuum distillation (45 to 50° C.) to obtain a pretreated mixture A (that was allowed to stand for 2 days) and a pretreated mixture B (that was allowed to stand for 7 days).

Figure 3:
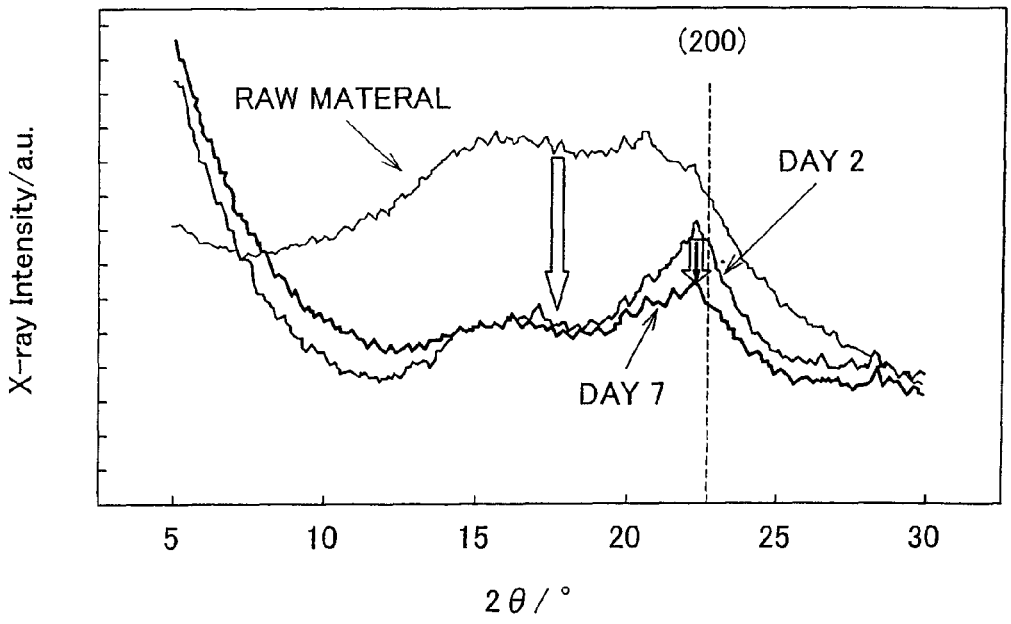
FIG. 3 shows the results of X-ray Diffraction (XRD) measurements in an example of the invention.

XRD analyses were carried out on each of the resulting pretreated mixtures A and B after drying at room temperature. In addition, XRD analysis was also carried out on dry cedar material prior to pretreatment (crushed to 150 μm or less, moisture content: about 4% by weight). The results for both pretreated mixtures are shown in FIG. 3. Furthermore, XRD measurements were carried out by measuring diffraction using a CuKα parallel beam.

According to FIG. 3, although XRD intensity of the pretreated mixture A, which was obtained by immersing the cedar material in an ethanol solution of heteropoly acid for 2 days, decreased as compared with the cedar material prior to pretreatment, a peak was confirmed for the (200) plane of cellulose crystals, and the apparent crystallinity increased. Namely, the amorphous portion of the cellulose is thought to have been solubilized with the crystallized cellulose portion remaining. On the other hand, the change in status after 2 days to the status after 7 days (pretreated mixture B) was less than the change from the status prior to pretreatment to the status after 2 days (pretreated mixture A). However, since the peak of crystalline cellulose again became less sharp, the crystalline portion of the cellulose can be observed to have gradually changed to the amorphous state. On the basis of the above, the cellulose was solubilized and crystallinity was clearly confirmed to decrease simply by immersing the plant fiber material in an organic solvent solution of cluster acid.

Figure 4:
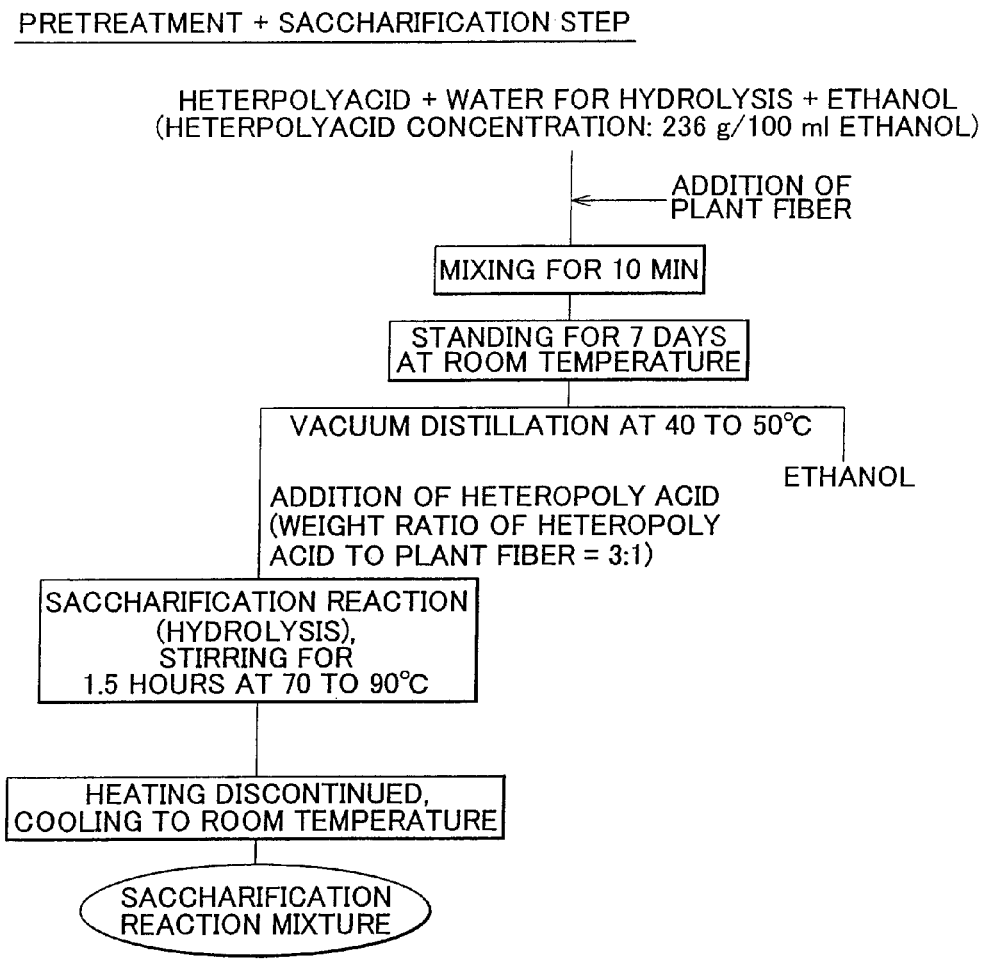
FIG. 4 shows a flow chart of pretreatment and saccharification step in Example 2 of the invention.

The following provides an explanation of Example 2 of the invention. The pretreatment and saccharification step are shown in FIG. 4. Phosphotungstic acid (heteropoly acid) was prepared by preliminarily adjusting the moisture content to be the crystallization water 30 by moisture absorption and drying. A solution was prepared by dissolving this phosphotungstic acid in guaranteed reagent grade ethanol to a concentration of 236 g/100 ml of ethanol. Next, 1 kg of plant fiber material in the form of crushed cedar (150 μm or less, moisture content: 4%) was placed in a reactor equipped with a stirrer. About 35 g of water required for hydrolysis were added to this reactor. Moreover, about 1 L of the previously prepared phosphotungstic acid ethanol solution was added followed by mixing for about 10 minutes. Moisture was confirmed to have spread throughout the mixture. Subsequently, the mixture was pretreated by allowing to stand for 7 days at room temperature. The ethanol was distilled off under reduced pressure at about 40 to 50° C. to obtain a pretreated mixture.

Next, about 1.4 kg of phosphotungstic acid of the crystallization water 30 were added so that the weight ratio of phosphotungstic acid to plant fiber was 3:1 in order to carry out a saccharification reaction. About 12 g of water were added to saturate the inside of the reactor with water vapor. Heating was carried out while stirring slowly (at several rpm) followed by waiting for the phosphotungstic acid to enter a pseudo-molten state. Subsequently, heating was intensified and the reaction was carried out for 10 minutes at about 90° C. Next, the temperature was lowered to about 70° C. and stirring was carried out for 1 hour at a stirring speed of 30 rpm. Moreover, the stirring speed was increased to 70 rpm and the reaction was allowed to proceed for an additional 20 minutes. In this manner, the total reaction time from the time the phosphotungstic acid entered a pseudo-molten state was 1.5 hours.

Figure 5:
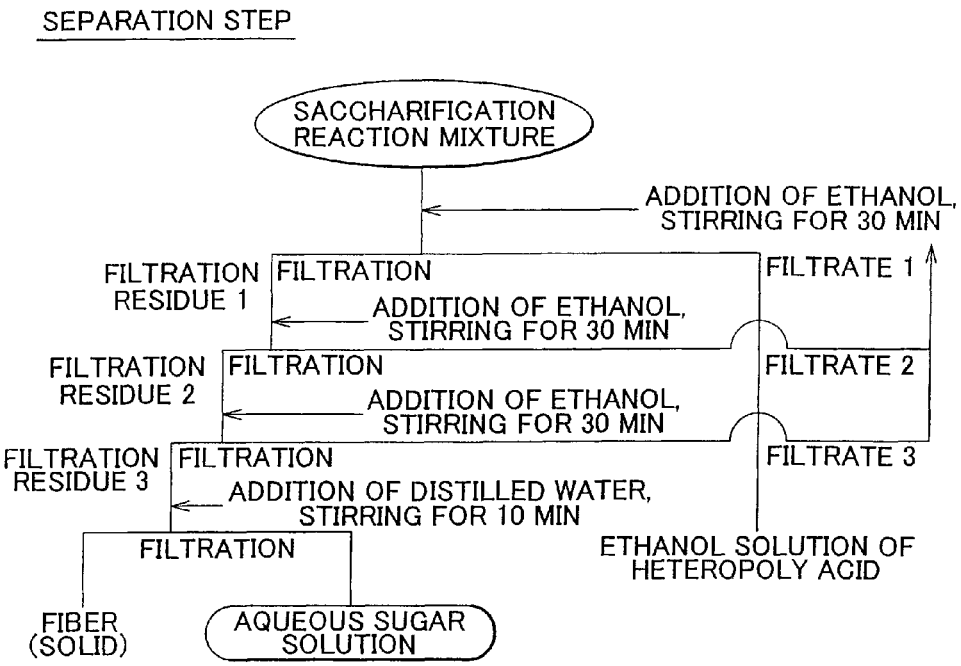
FIG. 5 shows a flow chart of separation step in Example 2 of the invention.

Next, as shown in FIG. 5, 1.5 L of ethanol were added to the saccharification reaction mixture in the reactor and after stirring for 30 minutes, the mixture was filtered to obtain a filtrate 1 and a filtration residue 1. The filtrate 1 (ethanol solution of heteropoly acid) was recovered. On the other hand, 1.5 L of ethanol were further added to the filtrate residue 1 and after stirring for 30 minutes, the mixture was filtered to obtain a filtrate 2 and a filtration residue 2. 1.5 L of ethanol were added to the filtration residue 2 and after stirring for 30 minutes, the mixture was filtered to obtain a filtrate 3 and a filtration residue 3. Distilled water was added to the resulting filtration residue 3 followed by stirring for 10 minutes. The resulting aqueous solution was filtered to obtain an aqueous sugar solution and a residue.

The solubilization and monosaccharification ratios in the pretreated mixture (at 0 hours saccharification reaction time) and the solubilization and monosaccharification ratios following the saccharification reaction (at 1.5 hours saccharification reaction time) were calculated. The results are shown in Table 1. Furthermore, each of the solubilization and monosaccharification ratios were calculated in the manner described below.

First, a portion of the pretreated mixture was removed and washed three times with ethanol in the same manner as the above-mentioned saccharification reaction mixture to obtain the filtration residue 3. Distilled water was added to the filtration residue 3 followed by stirring for 10 minutes. The resulting aqueous solution was filtered to obtain an aqueous sugar solution and a residue.

First, the resulting residue was completely oxidized by electromagnetic induction heating and introduction of oxygen, and the $CO_2$ that formed was quantified using a non-dispersive infrared (NDIR) analyzer to determine the carbon content of the residue. On the other hand, the carbon content of the plant fiber material prior to pretreatment was calculated using an NDIR in the same manner as the residue. Moreover, by assuming the carbon content of holocellulose (cellulose+hemicellulose) to be 44.5% by weight and assuming the carbon content of lignin and other materials to be 71.0% by weight, the ratio of holocellulose and lignin and other materials present in the plant fiber material (raw material) was determined from the carbon content of the plant fiber material, and the weights of holocellulose and lignin and other materials contained in the plant fiber material (raw material) were calculated. Next, the amount of holocellulose remaining in the residue was calculated from the weight of the residue and the carbon contents described above, and the solubilization ratio was determined according to the formula indicated below.

Solubilization ratio=[1−(amount of holocellulose in residue)/(amount of holocellulose in raw material)]×100%

Monosaccharides such as D-(+)-glucose, D-(+)-xylose, L-(+)-arabinose, D-(+)-mannose, D-(+)-galactose and D-(−)-fructose in the resulting aqueous sugar solution were quantified by high-performance liquid chromatography (HPLC) post-labeling trend detection followed by calculation of the total amount thereof. Monosaccharification ratios were then calculated based on the total amount of monosaccharides in the manner indicated below.

Monosaccharide yield (%)=[(total amount of monosaccharides actually recovered/(theoretical amount of monosaccharides formed when the entire amount of cellulose in the plant fiber material is converted to monosaccharides)]×100%

The solubilization and monosaccharification ratios after the saccharification reaction were calculated in the same manner as the solubilization and monosaccharification ratios of the pretreated mixture by using the residue and aqueous sugar solution obtained in the above-mentioned sugar separation step. The results are shown in Table 1.

TABLE 1

| | Saccharification reaction time (h) | Solubilization ratio (%) | Monosaccharification ratio (%) |
|---|---|---|---|
| Example 2 | 0 | 32.7 | 14.3 |
| | 1.5 | 100 | 71.2 |
| Example 3 | 0 | 30.5 | 15.5 |
| | 1.5 | 100 | 75.3 |
| Comparative Example 1 | 2 | 49.4 | 7.8 |
| Comparative Example 2 | 5 | 100 | 45.3 |

Figure 6A:
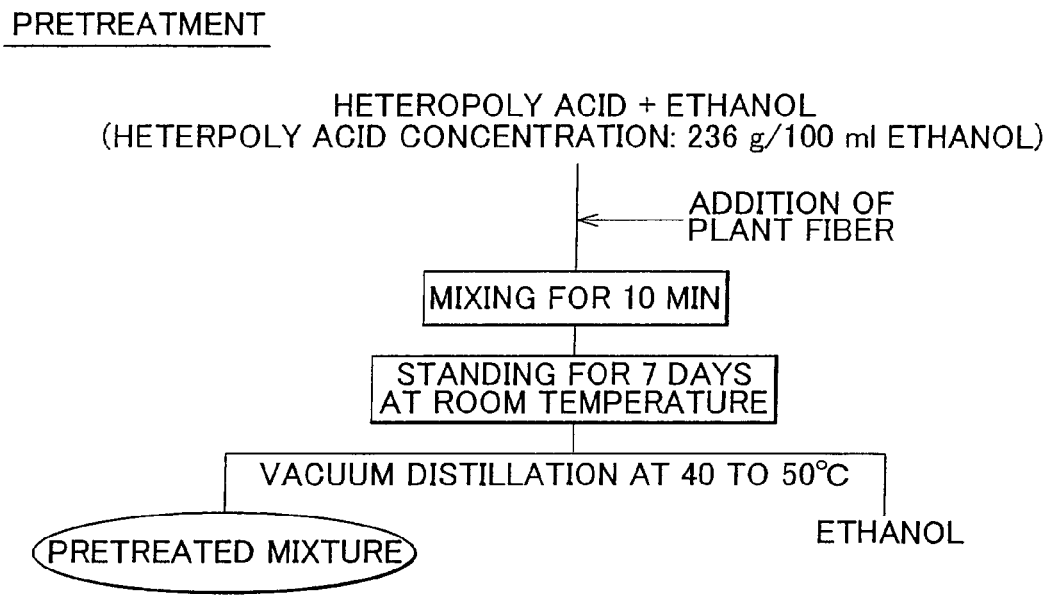
FIGS. 6A and 6B respectively shows flow charts for the pretreatment and saccharification step in Example 3 of the invention.
Figure 6B:
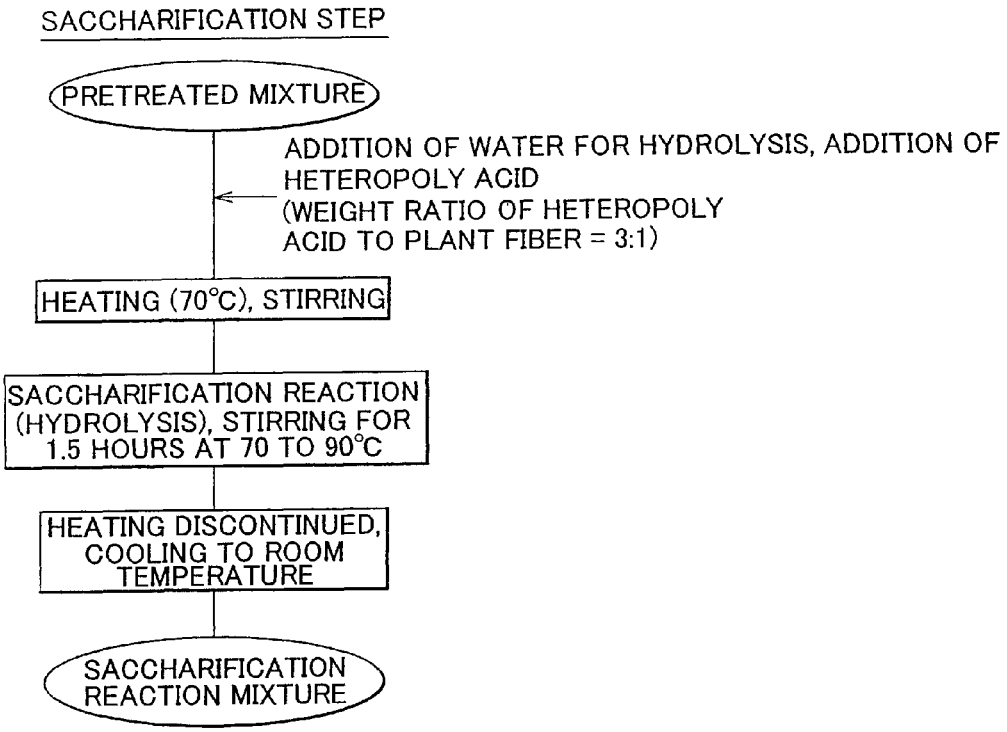

The following provides an explanation of Example 3 of the invention (see FIGS. 6A and 6B). Phosphotungstic acid (heteropoly acid) was prepared by preliminarily adjusting the moisture content to be the crystallization water 30 by moisture absorption and drying. A solution was prepared by dissolving this phosphotungstic acid in guaranteed reagent grade ethanol to a concentration of 236 g/100 ml of ethanol. Next, 1 kg of plant fiber material in the form of crushed cedar (150 μm or less, moisture content: 4%) was placed in a reactor equipped with a stirrer, and about 1 L of the previously prepared phosphotungstic acid ethanol solution was added followed by mixing for about 10 minutes. Moisture was confirmed to have spread throughout the mixture. Subsequently, the mixture was pretreated by allowing to stand for 7 days at room temperature. The ethanol was distilled off under reduced pressure at about 40 to 50° C.

Next, about 1.4 kg of phosphotungstic acid of the crystallization water 30 were added so that the weight ratio of phosphotungstic acid to plant fiber was 3:1 in order to carry out a saccharification reaction. Moreover, together with adding about 35 g of water required for hydrolysis, about 12 g of water were added to saturate the inside of the reactor with water vapor. Heating was carried out while stirring slowly (at several rpm) followed by waiting for the phosphotungstic acid to enter a pseudo-molten state. Subsequently, heating was intensified and the reaction was carried out for 10 minutes at about 90° C. Next, the temperature was lowered to about 70° C. and stirring was carried out for 1 hour at a stirring speed of 30 rpm. Moreover, the stirring speed was increased to 70 rpm and the reaction was allowed to proceed for an additional 20 minutes. In this manner, the total reaction time from the time the phosphotungstic acid entered a pseudo-molten state was 1.5 hours. Furthermore, the only difference between Example 2 and Example 3 is whether the water for hydrolysis was added during pretreatment or prior to the saccharification reaction. Next, an aqueous solution and a residue were obtained from the saccharification reaction mixture in the reactor in the same manner as Example 2.

The solubilization and monosaccharification ratios in the pretreated mixture (at 0 hours saccharification reaction time) and the solubilization and monosaccharification ratios following the saccharification reaction (at 1.5 hours saccharification reaction time) were calculated in the same manner as Example 2. The results are shown in Table 1.

The following provides an explanation of Comparative Example 1 of the invention. Distilled water was preliminarily placed in a reaction vessel so that water vapor was unable to escape to the outside following evaporation of the water, the reaction vessel was heated to the scheduled reaction temperature (70° C.), a saturated water vapor state was created inside the vessel, and the water vapor was allowed to adhere to the inside of the vessel. Next, 3 kg of phosphotungstic acid (heteropoly acid), for which the moisture content had been preliminarily adjusted to be the crystallization water 30 by absorption of moisture absorption and drying, and an amount of distilled water (35 g) that is deficient based on the total amount of water (75 g, excluding the above-mentioned water vapor component) required for hydrolyzing cellulose in the following cedar material (crushed to 150 μm or less, moisture content: about 4% by weight) to glucose, were loaded into the reaction vessel followed by stirring and heating to 70° C. To the reaction vessel 1 kg of the dried cedar material (plant fiber material, crushed to 150 or less, moisture content: about 4% by weight) was then added (ratio of heteropoly acid to plant fiber material=3:1) followed by continuing to stir for 2 hours at 70° C. Subsequently, heating was discontinued, the vessel was opened and the mixture was allowed to cool to room temperature while discharging excess water vapor. Next, an aqueous solution and a residue were obtained from the saccharification reaction mixture inside the vessel in the same manner as Example 2.

Solubilization and monosaccharification ratios following the saccharification reaction (at 2 hours saccharification reaction time) were calculated in the same manner as Example 2. The results are shown in Table 1.

The following provides an explanation of Comparative Example 2 of the invention. Solubilization and monosaccharification ratios (at 5 hours saccharification reaction time) were calculated in the same manner as Comparative Example 1 with the exception of continuing to stir for 5 hours at 70° C. The results are shown in Table 1.

As indicated by the results for the examples and comparative examples shown in Table 1, the solubilization ratio at 2 hours saccharification reaction time in Comparative Example 1, in which the plant fiber material was not pretreated, was less than 50% and the monosaccharification ratio was extremely low at 7.8%. In addition, in Comparative Example 2, in which the plant fiber material was not pretreated and the saccharification reaction time was set to 5 hours, although the solubilization ratio was 100%, the monosaccharification ratio was less than 50%. In contrast, in the case of carrying out pretreatment as in Example 2 or Example 3 of the invention, solubilization had already progressed and monosaccharification also had processed to a certain extent in the pretreated mixture prior to the saccharification step (at 0 hours saccharification reaction time). Moreover, monosaccharification ratios in excess of 70% were obtained despite the short saccharification reaction time of 1.5 hours.

While some embodiments of the invention have been illustrated above, it is to be understood that the invention is not limited to details of the illustrated embodiments, but may be embodied with various changes, modifications or improvements, which may occur to those skilled in the art, without departing from the scope of the invention.

The invention claimed is:

1. A pretreatment method for saccharification of plant fiber materials, comprising:

immersing the plant fiber material in a solution that contains an organic solvent, in which a cluster acid is dissolved, prior to saccharifying cellulose contained in the plant fiber material; and distilling off the organic solvent from the immersed plant fiber material to obtain a pretreated mixture that contains the cluster acid and the pretreated plant fiber material.

2. The pretreatment method according to claim 1, wherein the immersion of the plant fiber material is carried out at a temperature of 15 to 40° C.

3. The pretreatment method according to claim 2, wherein the temperature is the temperature of the organic solvent in which the cluster acid is dissolved.

4. The pretreatment method according to claim 1, wherein solubility of the cluster acid in the organic solvent is 100 g/100 ml or more, and a boiling point of the organic solvent is 50 to 100° C.

5. The pretreatment method according to claim 1, wherein the organic solvent is ethanol.

6. The pretreatment method according to claim 1, wherein the cluster acid is a heteropoly acid represented by the chemical formula HwAxByOz, where: A represents one element selected from the group consisting of phosphorous, silicon, germanium, arsenic and boron; and B represents one element selected from the group consisting of tungsten, molybdenum, vanadium and niobium.

7. The pretreatment method according to claim 1, wherein a weight ratio of the cluster acid to the plant fiber material is 0.5 to 3.

8. The pretreatment method according to claim 1, wherein the plant fiber material contains pectin and lignin.

9. The pretreatment method according to claim 1, wherein the plant fiber is saccharified by hydrolyzing the cellulose to produce a monosaccharide.

10. A saccharification method of a plant fiber material, comprising: hydrolyzing cellulose contained in the plant fiber material in a pretreated mixture with a cluster acid present in the pretreated mixture, the pretreated mixture being obtained by the pretreatment method according to claim 1, to produce a monosaccharide.

* * * * *